United States Patent [19]

Imaizumi et al.

[11] Patent Number: 4,540,297

[45] Date of Patent: Sep. 10, 1985

[54] PAPER HOLDING, FEEDING AND INSERTING APPARATUS FOR A PRINTER USING DIFFERENT KINDS OF SHEETS

[75] Inventors: Mamoru Imaizumi; Susumu Kuzuya, both of Nagoya, Japan

[73] Assignee: Brother Kogyo Kabushiki Kaisha, Nagoya, Japan

[21] Appl. No.: 462,953

[22] Filed: Feb. 1, 1983

[51] Int. Cl.[3] ..... B41J 13/10

[52] U.S. Cl. ..... 400/625; 400/605; 400/629; 400/636; 271/3

[58] Field of Search ..... 400/550, 605, 624, 625, 400/629, 636; 271/3, 3.1, 4, 9, 109, 117, 126, 157, 256

[56] References Cited

U.S. PATENT DOCUMENTS

| | | | |
|---|---|---|---|
| 1,627,015 | 5/1927 | Davidson | 271/126 X |
| 1,923,771 | 8/1933 | Barney | 400/629 |
| 2,836,279 | 5/1958 | Fischer | 400/636 X |
| 3,288,460 | 11/1966 | Eichorn | 271/19 |
| 3,523,685 | 8/1970 | Ehlscheid | 271/9 |
| 4,031,995 | 6/1977 | Blum et al. | 400/550 X |
| 4,273,456 | 6/1981 | Bisczat et al. | 400/550 |
| 4,391,542 | 7/1983 | Baitz | 400/624 X |
| 4,396,307 | 8/1983 | Shah et al. | 271/3 X |

FOREIGN PATENT DOCUMENTS

| | | | |
|---|---|---|---|
| 0045640 | 2/1982 | European Pat. Off. | 400/625 |
| 0146673 | 9/1982 | Japan | 400/624 |

*Primary Examiner*—Ernest T. Wright, Jr.
*Attorney, Agent, or Firm*—Browdy and Neimark

[57] ABSTRACT

A paper holding, feeding and inserting apparatus for a printer, comprising a first paper stacker for storing sheets of paper of one kind, a paper feeding device to feed the sheets from the first paper stacker to a printing station, and a second paper stacker which receives the printed sheets and is supported pivotally from its operative position to its inoperative position at which is provided a path along which a sheet of paper of another kind is inserted to the printing station. A drive motor to drive feed rollers of the paper feeding device may be controlled such that its operating speed is changed from an initial low speed to a higher speed during the feeding of a sheet to the printing station.

19 Claims, 6 Drawing Figures

PAPER HOLDING, FEEDING AND INSERTING APPARATUS FOR A PRINTER USING DIFFERENT KINDS OF SHEETS

BACKGROUND OF THE INVENTION

This invention relates to a printer such as a typewriter, and more particularly to a paper feeding apparatus for feeding individual sheets of paper to a printing station of the printer.

In the art of a paper feeding apparatus having a paper stacker or tray for storing a stack of paper sheets of one kind, it has been required to remove the paper stacker from a printer when it is desired to print on a sheet of paper of another kind which is different in size or format from said one kind. This removal of the stacker which is required to permit loading of said another kind of paper sheet without interference with the paper stacker, is cumbersome and time-consuming. There is also available in the art another type of paper feeding apparatus which has two paper stackers for feeding respective two kinds of paper different in size or format. In this type of feeding apparatus, one stacker is used for storing a frequently used kind of sheets and the other for storing another kind of sheets which are less frequently used and on which an interruption printing is effected while successive printings on the frequently used sheets are stopped temporarily. This two-stacker feeding apparatus is inherently complicated in construction and has a drawback that two or more sheets superposed for carbon copies are not smoothly and accurately fed because the feeding device acts on only the top sheet of a paper stack in the storage stacker.

On the other hand, it is also recognized in the field of feeding paper sheets from a paper stacker by using feed rollers that a high speed rotation on the rollers in an initial period of feeding will cause a slip between a sheet of paper and the rollers. This flip of the rollers on the paper sheet has been an obstacle to smooth and accurate feeding of the sheets to the printing station, and regarded as another drawback experienced in the art of a paper feeding device using feed rollers.

SUMMARY OF THE INVENTION

It is accordingly an object of the present invention to provide a paper feeding apparatus for a printer, which has a paper stacker for storing sheets of paper of one kind and is capable of allowing easy interruption of continuous or successive printings on such sheets of one kind, and fast setup for loading the printer with a sheet of paper of another kind different in size or format from said one kind and effecting during the interruption a printing operation on the another kind of sheets.

Another object of the invention is to provide a paper feeding apparatus for a printer, which is capable of feeding individual sheets of paper one after another to a printing assembly of the printer in a smooth and accurate manner without a slipping trouble of feed rollers experienced in the art.

According to the present invention, there is provided a paper feeding apparatus for a printer having a printing assembly, comprising:

a frame secured to the printer;

a first paper handling assembly supported by the frame and having a first paper stacker for storing sheets of paper of one kind and a paper feeding device for feeding the sheets of paper of one kind from the first paper stacker along a first paper inlet path to the printing assembly; and a second paper handling assembly having a second paper stacker for receiving the sheets of paper of one kind after they are printed by the printing assembly; and support means, retained by the frame, for supporting the second paper handling assembly pivotally between a first position at which the second paper handling assembly is operative to receive the printed sheets of paper of one kind in the second paper stacker, and a second position at which the second paper handling assembly is inoperative and a second paper inlet path leading to the printing assembly is provided;

whereby sheets of paper of another kind different from said one kind are loaded to the printing assembly along the second paper inlet path when the second paper handling assembly is placed in its second position.

In one preferred form of the feeding apparatus of the invention, detection means is provided to detect the selected position of the second paper handling assembly, the detection means generating a signal to prevent the first paper handling assembly from normally operating to feed the sheets of paper of said one kind by the paper feeding device when the second paper handling assembly is placed in its second position.

In the paper feeding apparatus constructed according to one aspect of the invention, the second paper handling assembly for receiving sheets of paper of one kind which have been fed from the first paper stacker along a first paper inlet path and printed by the printing assembly of a printer, is easily pivotable from its first, operative position to its second, inoperative position. When the second assembly is held in the second position by the lock means, there is provided a second paper inlet path passing adjacent the second paper handling assembly and leading to the printing assembly, which second paper inlet path allows sheets of another kind of paper to be fed to the printing assembly for effecting an interruption printing operation while successive printing jobs on the sheets of paper of said one kind are suspended temporarily. Thus, the present invention provides a simply constructed paper feeding arrangement which is easily set up for accomplishing the interruption printing.

According to another aspect of the present invention, there is provided a paper feeding apparatus for a printer including a printing assembly, which comprises:

a first paper stacker for storing a stack of paper sheets;

a paper feeding device for feeding the individual paper sheets one after another to the printing assembly, the paper feeding device including a feed roller disposed adjacent the first paper stacker;

a second paper stacker for receiving the printed paper sheets after they are printed by the printing assembly;

drive means operatively connected to the feed roller for rotating the feed roller;

trigger means for starting the drive means; and a control device, connected to the drive means and the trigger means, for controlling the drive means to operate same at one speed for a predetermined initial time interval after activation of the trigger means, and at another speed higher than said one speed for a predetermined subsequent time interval.

In the paper feeding apparatus arranged as described above, the initial rotation of the feed roller is adapted to be low so that no slip takes place between the roller and the paper sheet. As a result, the paper sheet is smoothly and stably fed and accurately directed to the printing assembly. Further, the feeding efficiency is kept high thanks to an increase in the rotation speed of the roller after a predetermined initial time interval has elapsed.

BRIEF DESCRIPTION OF THE DRAWING

The above and other objects, features and advantages of the present invention will become more apparent from reading the following description of the preferred embodiment taken in connection with the accompanying drawing in which.

DETAILED DESCRIPTION OF THE PREFERRED EMBODIMENT

Figure 1:
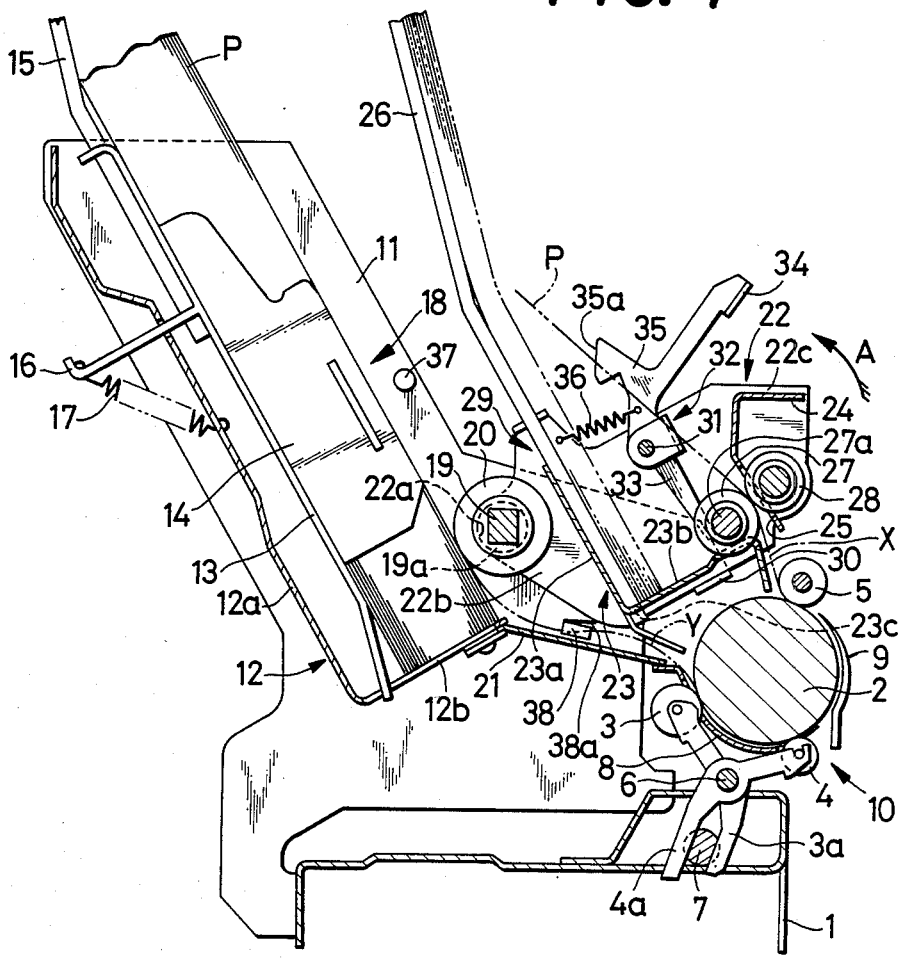
FIG. 1 is a side cross sectional view of a paper feeding apparatus, showing a first paper handling assembly including a first paper stacker in the state of feeding a sheet of paper of one kind from the first stacker, and a second paper handling assembly including a second stacker in the state wherein the second assembly is set in its first or paper-receiving position.

A preferred embodiment of the present invention will be described below in detail with reference to the accompanying drawing of FIGS. 1 through 5, wherein a frame 1 of a printer supports a platen 2 and three feed rollers 3, 4 and 5 which are adapted to be in rolling contact with the circumference of the platen 2. The first and second feed rollers 3 and 4 located beneath the platen 2 are rotatably supported by a pair of carrier arms 3*a* and 4*a* respectively, which arms 3*a* and 4*a* are pivotally mounted on a support shaft 6 in a criss-crossed relation with each other at the shaft 6. The carrier arms 3*a* and 4*a* are shaped so that their lower portions contact with a cam 7 interposed therebetween. A rotary motion of the cam 7 causes the first and second feed rollers 3 and 4 to disengage from or to be put out of contact with the circumferential surface of the platen 2. The three feed rollers 3, 4 and 5 cooperate with the platen 2 to feed and guide a sheet of paper P from above the platen 2 in a counterclockwise direction (as viewed in the drawing) along the circumference of the platen 2. Reference numeral 8 designates a paper guide pan, and numeral 9 represents a card-holder carried by a printing assembly generally indicated at 10 including a type element (not shown) in the form of a type wheel or the like.

On the printer frame 1, there are secured a pair of side frames 11 of planar configuration extending in an obliquely upward direction of the right and left sides of the frame 1. Between rear portions of the side frames 11 is fixed a support frame 12 of substantially L-letter shape in cross section as shown in the drawing, consisting of a rear plate 12*a* and a bottom plate 12*b*. This support frame 12 carries a receiver plate 13 extending almost in parallel to the rear plate 12*a* and movable away from and toward the plate 12*a*. The receiver plate 13 has a pair of positioning side plates 14 extending on right and left sides thereof in a direction away from the rear plate 12*a* of the support frame 12. A paper support frame 15 is secured to the receiver plate 13 which extends in an obliquely upward direction. The receiver plate 13 further has an extension 16 extending rearwardly from the rear surface thereof. One end of the extension 16 remote from the rear surface is connected to one end of a coil spring 17 the other end of which is connected to the rear plate 12*a* of the support frame 12 so that the receiver plate 13 is biased forward, i.e., in a direction away from the rear plate 12*a*. The support frame 12, receiver plate 13, paper support frame 15, etc. constitute a first paper stacker 18 wherein the sheets of paper P to be printed are stacked one on another on the receiver plate 13 with their lower edges abutting on the bottom plate 12*b* of the support frame 12. A stack of paper P thus resting on the receiver plate 13 and the bottom plate 12*b* is laterally positioned by the side positioning plates 14 which abut on both right and left edges of the stacked paper sheets. The upper end portion of the paper stack extending beyond the upper end of the receiver plate 13 is supported by the paper support frame 15.

Figure 2:
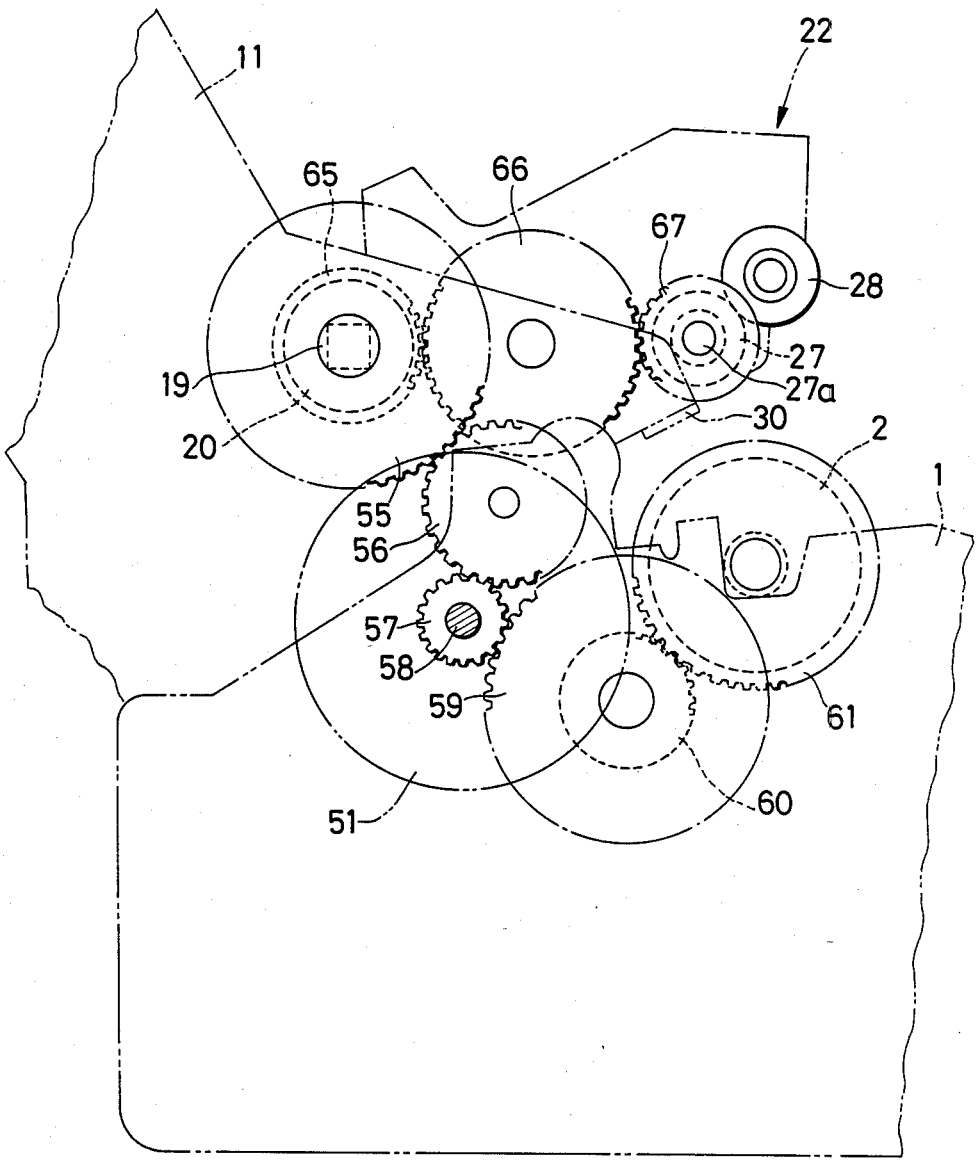
FIG. 2 is a schematic view in cross section of power transmission lines of the paper feeding apparatus of FIG. 1, which connect a feed drive motor and elements driven by this motor for paper feeding.
Figure 3:
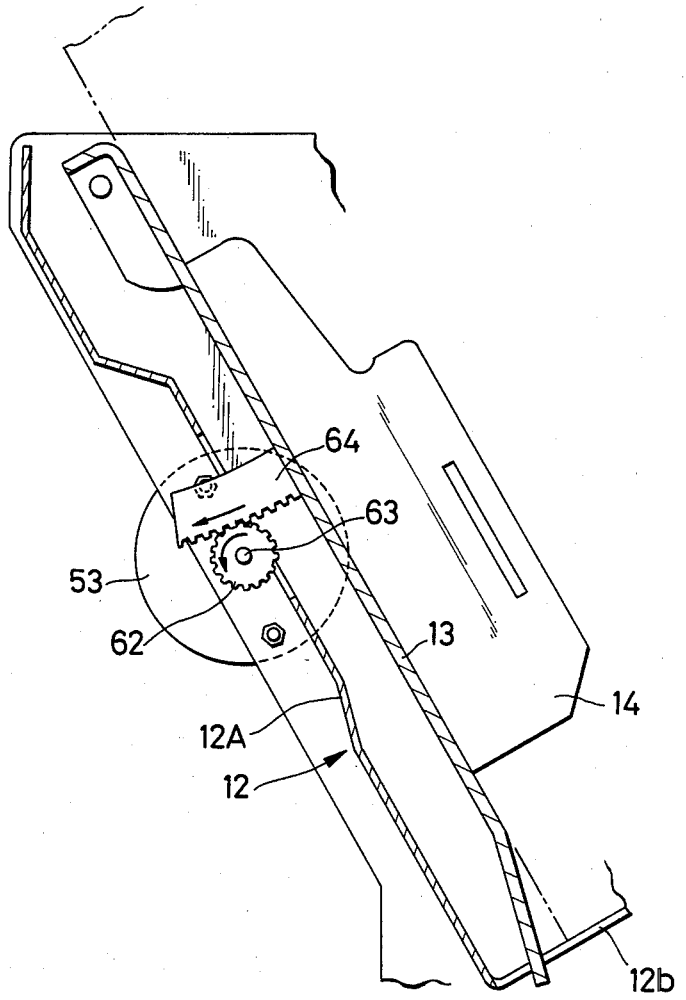
FIG. 3 is a schematic view showing a connection between a stacker drive motor and a receiver plate of the first stacker of FIG. 1.

In front of the lower portion of the first paper stacker 18 and at a position adjacent the top sheet P of a paper stack, there is provided a drive shaft 19 which is connected to a stepper motor 51, as shown in FIG. 2, via a gearing transmission which comprises a gear 55 fixed to the drive shaft 19, a gear 56, a gear 57 fixed to an output shaft 58 of the stepper motor 51. As described later, this stepper motor 51 is designed as drive means to operate the platen 2 and paper ejection rollers 27, 28 as well as the shaft 19. The shaft 19 is rotatably supported by and between the right and left side frames 11 such that the shaft 19 extends in parallel to the platen 2 or a line of printing. The drive shaft 19 carries thereon feed drove rollers 20 made of rubber or like materials. The first paper stacker 18 and the feed drive rollers 20 are adapted such that the top sheet P of a paper stack stored in the stacker 18 is normally kept in rolling contact with the circumference of the rollers 20 under pressure of the coil spring 17. Since the stepper motor 51 connected to the drive shaft 19 is also connected to the platen 2, as shown in FIG. 2, via a gearing transmission which comprises the gear 57, intermediate gears 59, 60, and a platen gear 61 fixed to the platen 2, the feed drive rollers 20 are rotated in synchronization with the platen 2 in a counterclockwise direction as seen in the drawing, whereby the top sheet P is fed along a guide plate 21 and the leading edge is directed up to the platen 2 and the printing assembly 10. When the paper feeding is not effected, the first paper stacker 18 is controlled by a first stacker control device 52 shown in FIG. 5 so that the receiver plate 13 is moved by a drive motor 53 against a biasing force of the coil spring 17 to a position at which the top of a paper stack is spaced away from the feed drive rollers 20, as illustrated in FIG. 2. As shown in FIG. 3, this stacker drive motor 53 is coupled to the receiver plate 13 via a pinion 62 fixed to an output shaft 63 of the motor 53, and a rack 64 fixed to the receiver plate 13 and engaging the pinion 62. The first paper stacker 18, drive shaft 19, feed drive rollers 20, etc.

constitute a first paper handling assembly, and the drive shaft 19, drive rollers 20, guide plate 21, etc. constitute paper feeding means.

On cylindrical right and left end portions 19*a* of the drive shaft 19, there are pivotally supported a pair of bracket plates 22, respectively such that mounting holes 22*a* formed in the rear portion 22*b* of the bracket plates 22 engage the respective cylindrical end portions 19*a* of the shaft 19. The bracket plates 22 which are designed as a bracket device are pivoted about the shaft 19 integrally with a support member 23 secured to and interposed between the rear portions 22*b* of the plates 22 and with a guide member 24 similarly secured to and interposed between the front portion 22*c* of the plates 22. The support member 23 is of substantially L-letter shape in cross section, consisting of a rear portion 23*a* normally extending in an obliquely upward and rearward direction and a bottom portion 23*b* normally extending in an obliquely upward and frontward direction. The front end part of the bottom portion 23*b* of the support member 23 is bent so that it cooperates with the lower end part of the guide member 24 to define an opening 25 therebetween, which opening 25 forms a part of a paper ejection path X (FIG. 1). The bottom portion 23*b* has holes 23*c* through which the lower portions of a paper receiver frame 26 are inserted removably such that the frame 26 extends substantially in parallel with the rear portion 23*a* of the support member 23.

Upwardly adjacent the above indicated opening 25 are rotatably supported a pair of paper ejection rollers 27, 28 which are connected to the drive shaft 19, as also shown in FIG. 2, via a gearing transmission comprising a gear 65, fixed to the drive shaft 19, an intermediate gear 66, and a gear 67 fixed to a shaft 27*a* supporting the ejection roller 27, so that the ejection rollers 27, 28 are and rotated synchronously with the platen 2. The sheet of paper P on which a printing is effected by the printing assembly 10 is advanced, through the nip between the third feed rollers 5 and the platen 2, to the ejection rollers 27 and 28 which eject the sheet P upwardly so that the sheet P is received by the support member 23 and the receiver frame 26. Thus, the member 23 and the frame 26 constitute a second paper stacker 29. This second paper stacker 29, bracket plates (bracket device) 22, guide member 24, ejection rollers 27, 28, etc. constitute a second paper handling assembly. The second paper handling assembly is maintained at its first position shown in FIG. 1 by stopper portions 30 of the side frames 11 extending laterally inwardly at their front ends. In this first position, the stopper portions 30 abut on the bottom surfaces of the bracket plates 22 which are biased to rotate in a clockwise direction as seen in FIG. 1 by gravity, thereby preventing the second paper stacker 29 from pivoting downwardly from the first position at which the second paper handling assembly is ready to operate for receiving printed sheets of paper P from the printing assembly 10. The second paper handling assembly, more specifically, the second paper stacker 29 is pivotable about the drive shaft 19 from the first, paper receiving position of FIG. 1 up to a second position shown in FIG. 4. In this second position, the previously stated paper ejection path X including the opening 25 is lost whereby the second paper handling assembly is placed in the inoperative position. Thus, the second paper handling assembly and the second paper stacker 29 are pivotable between the first and second positions selectively.

The right and left bracket plates 22 are provided, at their upper inner surfaces, with a pair of rotatable support shafts 31 whose inner ends face each other. A 3-arm lock member 32 is pivotally supported on each of these rotatable shafts 31. The lock member 32 includes a stop arm 33 normally extending downwardly, an operating arm 34 normally extending obliquely upwardly and frontwardly, and a hook arm 35 of saw-tooth shape extending rearwardly of the operating arm 34 and having a cam surface 35*a* at its rear end. The lock member 32 is biased by a tension spring 36 so that its stop arm 33 is kept in engagement with the circumference of the shaft 27*a* of the ejection roller 27. In other words, the tension spring 36 urges the lock member 32 so that the latter is pivoted in a counterclockwise direction as seen in FIG. 1.

Figure 4:
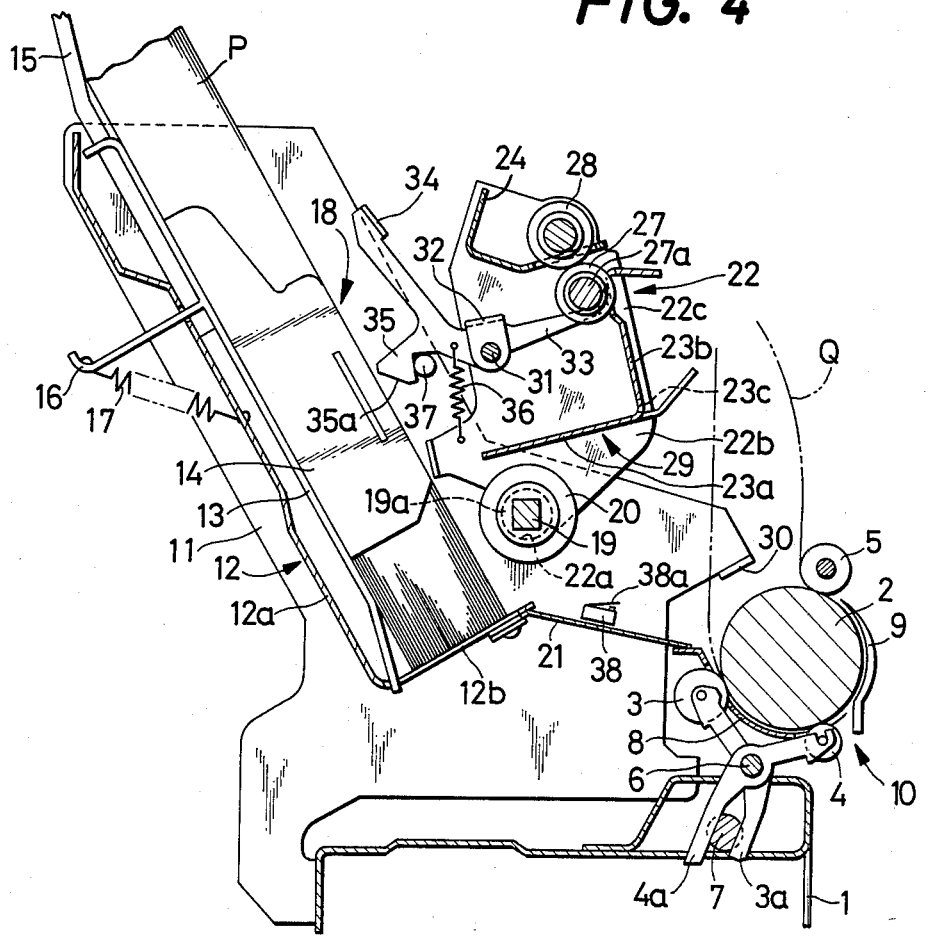
FIG. 4 is a view similar to FIG. 1 showing the second paper handling assembly set in its second position at which a sheet of paper of another kind can be fed to a printing assembly of a printer.

On the other hand, a pair of engagement pins 37 are provided on the right and left side frames 11, respectively, which pins 37 are positioned so that they are engageable with the respective hook arms 35 when the second paper handling assembly is upwardly pivoted to its second position. Thus, the lock members 32 engaging the engagement pins 37 hold the second paper handling assembly at its second, inoperative position as illustrated in FIG. 4. As described above, the second paper stacker 29 is supported by support means including the drive shaft 19 and the bracket device consisting of the bracket plates 22, and maintained at the second position by lock means including the lock members 32 and the engagement pins 37. When the second paper stacker 29 or the second paper handling assembly is held at its second position, a sheet of paper Q of a kind which is different from the sheet of paper P may be manually fed and guided to the printing assembly 10 and a printing may be effected on the sheet of paper Q.

On the inner surface of one of the side frames 11 is disposed a micro-switch 38 designed as detection means for sensing the currently selected position of the second paper handling assembly. When the second assembly is set in the first or operative position of FIG. 1, an armature 38*a* of the micro-switch 38 is in contact with the bottom surface of the appropriate one of the bracket plates 22 and a detection signal is presented from the switch 38 to allow the first paper handling assembly to feed the sheets of paper P from the first paper stacker 18. When the second paper handling assembly is pivoted to its second or inoperative position, the armature 38*a* disengages from the bracket plate 22 whereby the micro-switch 38 signals the first stacker control device 52 for operating the previously indicated motor 53 to set the first paper stacker 18 in a position at which the top sheet P of a paper stack is spaced away from the feed drive roller 20, and the paper feeding from the first stacker 18 is stopped or prevented.

Although the terms "first position" and "second position" have been in the foregoing description primarily in connection with the second paper handling assembly, those terms are equally or similarly applicable to the second paper stacker 29, bracket plates 22 (bracket device), ejection rollers 27, 28 and any other parts movable with the bracket device between the two positions.

Figure 5:
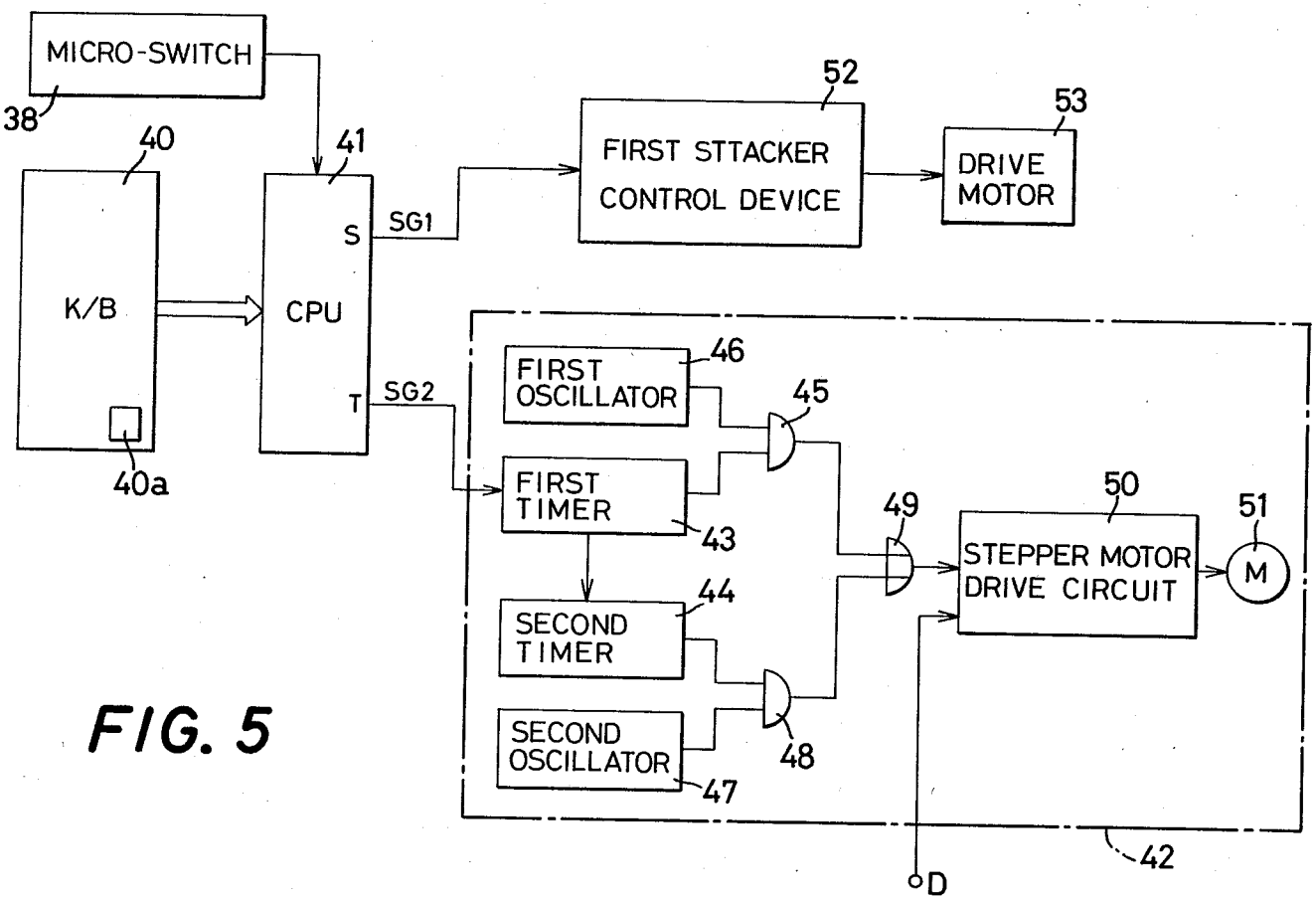
FIG. 5 is a schematic block diagram illustrating a circuit for controlling a paper feeding operation of the feeding apparatus of FIGS. 1 through 4.

Referring next to FIG. 5, a control circuit for operating the feed drive rollers 20 is described. In the figure, a keyboard 40 is provided with a PAPER INSERT switch 40*a*, a manually operated member designed as trigger means to start feeding a sheet of paper P. Output terminals of the keyboard 40 are connected to a central processing unit (CPU) 41 whose output terminal T is connected to a first timer 43 of a stepper motor control device 42 which controls a speed of rotation of the feed drive rollers 20. One output of the first timer 43 is connected to an input of a second timer 44 and the other output of one of two inputs of an AND gate 45. The other input of the AND gate 45 is connected to an output of a first oscillator 46 which oscillates at a predetermined frequency n (Hz). An output of the second timer 44 and an output of a second oscillator 47 are applied to two inputs of another AND gate 48, respectively. The second oscillator 47 oscillates at a frequency 4 n (Hz) which is four times as high as the frequency of the first oscillator 46. Outputs of the AND gates 45 and 48 are applied to two inputs of an OR gate 49, respectively, an output of the OR gate 49 being connected to a stepper motor drive circuit 50 whose output is connected to an excitation coil of the stepper motor 51.

As previously described, the output shaft 58 of the stepper motor 51 is connected to the platen 2 and drive shaft 19 in order to rotate the platen 2 and the feed drive rollers 20.

On the other hand, an output terminal S of the CPU 41 is connected to the first stacker control device 52 for controlling the drive motor 53 to move the receiver plate 13 toward and away from the feed drive rollers 20.

The operation of the paper feeding apparatus constructed as described hereinbefore is now described below.

When the PAPER INSERT switch 40*a* on the keyboard 40 is activated while the second paper handling assembly is placed in its first position, a command signal SG1 is generated from the output terminal S of the CPU 41 and applied to the first stacker control device 52 which in turn stops the drive motor 53 which then remains at rest. In this condition, the receiver plate 13 is moved with the resilient force of the coil spring 17 until the top of a stack of the paper sheets P is forced against the circumference of the feed drive rollers 20.

Figure 6:
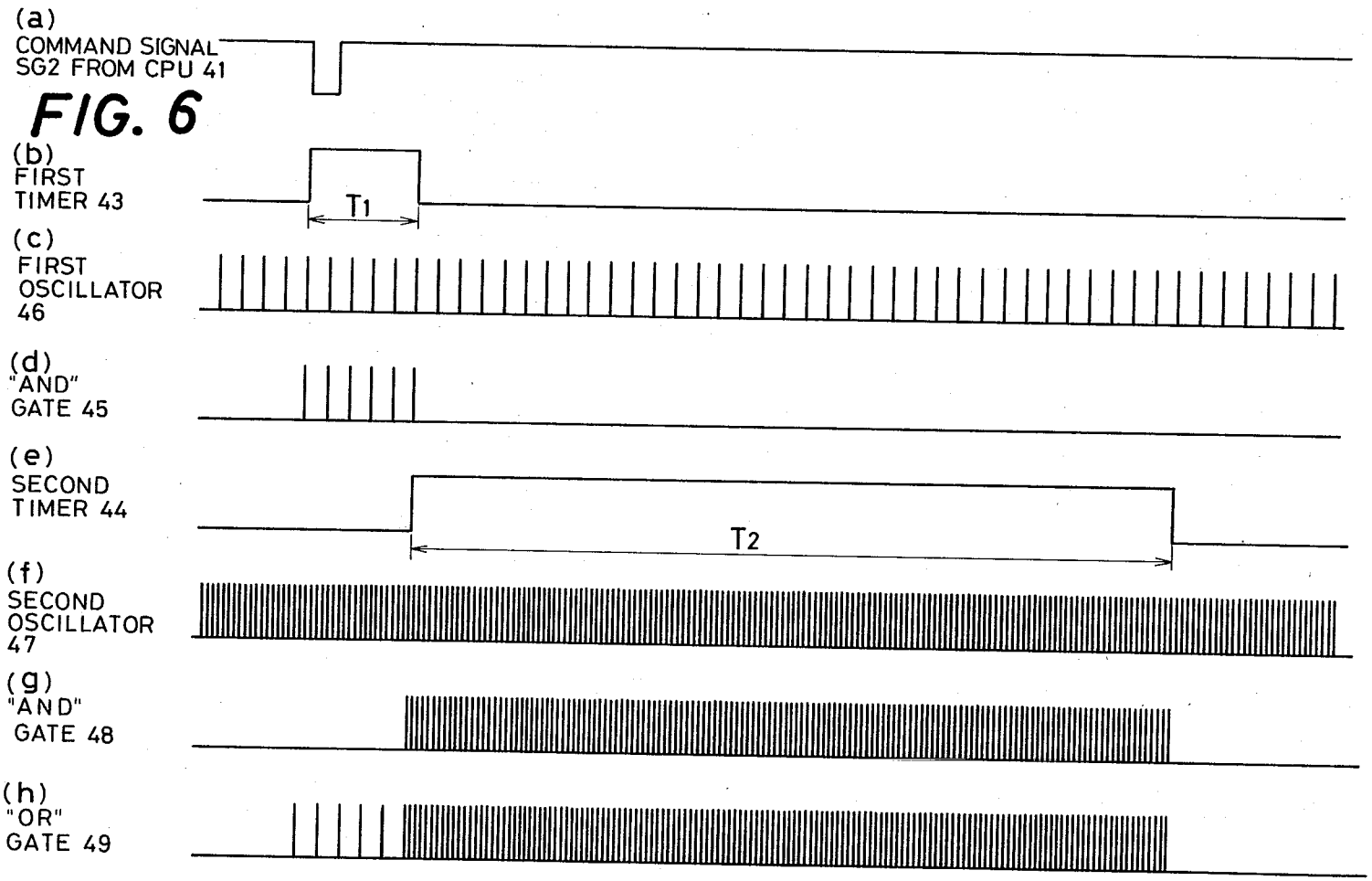
FIG. 6 is a diagrammatic representation showing the operation of a stepper motor control circuit of the feeding apparatus.

Successively, a command signal SG2 is generated from the output terminal T of the CPU 41 as illustrated in FIG. 6(*a*). Upon generation of the command signal SG2, the first timer 43 is operated for a predetermined time interval T1 as shown in FIG. 6(*b*). As the first oscillator 46 is oscillating at the frequency n (Hz) at this time as illustrated in FIG. 6(*c*), the AND gate 45 generates pulse signals at the same frequency n (Hz) for the predetermined time interval T1 as shown in FIG. 6(*d*). Upon expiration of the time interval T1 with the first timer 43 timed out, the second timer 44 is operated for another predetermined time interval T2 as indicated in FIG. 6(*e*). Since the second oscillator 47 is oscillating at the frequency 4 n (Hz) at this time as seen in FIG. 6(*f*), the AND gate 48 generates pulse signals at the same frequency 4 n (Hz) for the predetermined time interval T2 as indicated in FIG. 6(*g*). Thus, as is apparent from FIG. 6(*h*), the OR gate 49 applies to the stepper motor drive circuit 50 the pulse signals at the frequency n (Hz) for the time interval T1, and then the pulse signals at the frequency 4 n (Hz) for the following time interval T2 in response to the command signal SG2 fed from the CPU 41. Consequently, the stepper motor 51 is operated in response to the pulse signals, i.e., rotated at a low speed for the initial time interval T1 and at a high speed for the subsequent time interval T2, whereby the feed drive rollers 20 and the platen 2 are rotated counterclockwise as seen in FIGS. 1, 2 and 4 for the total length of time T1+T2 thereby feeding the top sheet P past the guide plate 21 toward the printing assembly 10. With this arrangement, the feed rollers 20 are rotated so that the paper sheet P is fed initially at one inch per second (1 in./sec.) and subsequently at four inches per second (4 in./sec.) along a first paper inlet path Y defined by the guide plate 21, platen 2 and feed rollers 3, 4.

As described above, the initial rotation speed of the feed drive rollers 20, i.e., the initial paper feeding speed is adapted to be low so that no slip will take place between the rollers 20 and the paper sheet P. Thus, the sheet P is stably fed and accurately directed to the printing assembly 10. Moreover, the paper feeding will not take a long time because the rotation speed of the rollers 20 and the platen 2 is increased after the first timer 43 has been timed out.

After the sheet P has been advanced to the printing start position the drive motor 53 is operated by the first stacker control device 52 to withdraw the first paper stacker 18 so that the top sheet P of a paper stack in the stacker 18 is spaced away from the rollers 20, that is, the rotary movement of the rollers 20 is made ineffective. Application of pulse signals from an input terminal D (FIG. 5) to the stepper motor drive circuit 50 in this condition will permit the platen 2 to be rotated thus advancing the sheet P while a printing operation is effected thereon in the desired number of lines. Upon completion of the printing operation, the printed sheet P is driven by the ejection rollers 27 and 28 and received in the second paper stacker 29. Thus, a plurality of printed sheets of paper P are stacked one on another in the second stacker 29 as indicated in broken lines in FIG. 1.

If it is desired to perform a printing operation on a sheet of paper Q which is different in size or format from a sheet of paper P, the stack of printed paper P in the second stacker 29 is first removed and the paper receiver frame 26 is then taken out by pulling it upward. Then, the second paper handling assembly, i.e., the bracket device 22 is manually pivoted about the drive shaft 19 in the direction of arrow A in FIG. 1 until the cam surface 35*a* of the hook arm 35 of the lock member 32 is brought into abutment on the engagement pin 37. A further pivotal movement of the second assembly will cause the lock member 32 to be rotated a slight angle in the clockwise direction as seen in FIG. 1, thereby bringing the hook arm 35 into engagement with the engagement pin 37. In this manner, the second paper handling assembly is held in its second, inoperative position. In this position, an open space is provided above the platen 2 and adjacent the pivoted second paper handling assembly.

Upon pivotal movement of the second paper handling assembly toward its second position, the armature 38*a* of the micro-switch 38 is freed from depression by the bottom surface of the bracket plate 22, whereby the micro-switch 38 signals the control device 52 so that the receiver plate 13 of the first paper stacker 18 is withdrawn by the motor 53 from the position of FIG. 1 to the position of FIG. 2 at which the top of the paper stack P stored in the stacker 18 is offset from the feed drive rollers 20 and consequently the paper feeding from the stacker 18 is made impossible. When the PAPER INSERT switch 40*a* on the key board 40 is activated while the second paper handling assembly is in the second position and the first paper stacker 18 in the position of FIG. 4, no sheet of paper P is fed from the first paper stacker 18 but a sheet of paper Q of another kind manually loaded through the open space formed above the platen 2 by the pivotal movement of the second assembly to its second position is automatically advanced through rotation of the platen 2 triggered by activation of the PAPER INSERT switch 40*a*. Thus, a desired printing on the sheet Q can be effected, by the printing assembly 10 in the usual manner, while successive printing operations on the sheets of paper P are being interrupted.

As discussed above, the second paper handling assembly including the second paper stacker 29 of a paper feeding apparatus according to the present invention can be readily positioned so as to provide an open space above the platen 2, which space provides a second paper inlet path along which another kind of paper Q is loaded to the platen 2 without having to remove the stacker 29 as required on a printer equipped with a conventional paper feeder. Thus, virtually no time and labor are required to remove the stacker 29 from the printer. In addition, unlike a paper feeding apparatus having two fresh paper stackers or trays for two kinds of papers, the paper feeding apparatus of the invention is simple in construction because of its single fresh paper stacker 18 and easy in setup for interruption printing because of quick changeover of the second paper handling assembly from the first to second position as described previously. Another advantage of the present paper feeding apparatus is that two or more superposed sheets of paper Q can be manually loaded smoothly and accurately by setting the second assembly in the second position when carbon copies are required in addition to an original copy.

While the present invention has been described in its preferred embodiment, it is to be understood that the invention is not limited thereto but may be otherwise embodied within the scope of the following claims.

What is claimed is:

1. A paper feeding apparatus for a printer having a printing assembly, which comprises:

a frame secured to said printer;

a first paper handling assembly supported by said frame and having a first paper stacker for storing sheets of paper of one kind and a paper feeding device for feeding said sheets of paper of one kind from said first paper stacker along a first paper inlet path to said printing assembly;

a second paper handling assembly having a second paper stacker for receiving said sheets of paper of one kind after they are printed by said printing assembly; and support means, retained by said frame for supporting said second paper handling assembly pivotally between a first position at which the second paper handling assembly is operative to receive the printed sheets of paper of said one kind in said second paper stacker, and a second position at which the second paper handling assembly is inoperative and a second paper inlet path leading to said printing assembly is provided adjacent said second paper handling assembly, a pivotal movement of said second paper handling assembly between said first and second positions being effected without a pivotal movement of said first paper handling assembly, whereby sheets of paper of another kind different from said one kind are loaded to said printing assembly along said second paper inlet path when said second paper handling assembly is placed in its second position.

2. A paper feeding apparatus as recited in claim 1, further comprising detection means for detecting the selected position of said second paper handling assembly, said detection means generating a signal to prevent said first paper handling assembly from normally operating to feed the sheets of said one kind by said paper feeding device thereof when said second paper handling assembly is placed in its second position.

3. A paper feeding apparatus as recited in claim 1, wherein said support means includes a bracket device pivotable about an axis in parallel to a line of printing by said printing assembly.

4. A paper feeding apparatus as recited in claim 3, wherein said bracket device is pivoted from said first position to said second position in a direction away from said printing assembly.

5. A paper feeding apparatus as recited in claim 3, further comprising means for biasing said bracket device to said first position and lock means for locking the bracket device at said second position resisting a biasing force of said biasing means.

6. A paper feeding apparatus as recited in claim 5, wherein said lock means includes a lock member pivotally supported on said support means and having a hook portion, and an engagement member secured to said frame and engageable with said hook portion when said second paper handling assembly is placed in said second position.

7. A paper feeding apparatus as recited in claim 3, wherein said paper feeding device includes a drive shaft extending in parallel to said axis, said bracket device being pivotally supported by said drive shaft.

8. A paper feeding apparatus as recited in claim 7, wherein said second paper handling assembly includes paper ejection rollers rotatably carried by said bracket device and driven by said drive shaft for ejecting the printed sheets of paper of said one kind into said second paper stacker.

9. A paper feeding apparatus as recited in claim 1, wherein said second paper stacker comprises a support member secured to said support means for holding the printed sheets of paper of said one kind, and a paper receiver frame mounted on said support member removably when said second paper handling assembly is pivoted to said second position.

10. A paper feeding apparatus as recited in claim 1, wherein said paper feeding device comprises at least one feed roller disposed adjacent said first paper stacker, and which further comprises:

drive means operatively connected to said feed roller for rotating said feed roller;

trigger means for starting said drive means; and a control device, connected to said drive means and said trigger means, for controlling said drive means to operate said drive means at one speed for a predetermined initial time interval after activation of said trigger means, and at another speed higher than said one speed for a predetermined subsequent time interval.

11. A paper feeding apparatus for a printer having a printing assembly and a platen, which comprises:

a frame secured to said printer;

a first paper handling assembly supported by said frame and having a first paper stacker including a receiver plate for storing sheets of paper of one kind, and further having a paper feeding device for feeding said sheets of paper of one kind from said first paper stacker along a first paper inlet path to said printing assembly via said platen, said paper feeding device including a drive shaft rotatably supported by said frame and extending in parallel to said platen and further including feed drive rollers carried by said drive shaft;

a second paper handling assembly having a second paper stacker for receiving said sheets of paper of one kind after they are printed by said printing assembly, said second paper handling assembly further having ejection rollers for ejecting the printed sheets of paper into said second paper stacker;

support means for supporting said second paper handling assembly, said support means including said drive shaft and a bracket device supported by said drive shaft pivotally about the axis of said shaft between a first position at which said second paper handling assembly is operative to receive the printed sheets of paper of said one kind in said second paper stacker through said ejection rollers, and a second position at which the second paper handling assembly is inoperative and a second paper inlet path leading to said platen is provided adjacent said second paper handling assembly;

lock means for holding said bracket device at said second position;

a stacker drive motor to move said receiver plate of said first paper stacker; and detection means for detecting the selected position of said bracket device, said detection means generating a signal commanding said stacker drive motor to set said receiver plates of said first paper stacker to an inoperative position at which the top of a stack of paper of said one kind is spaced away from said feed drive rollers when said bracket device is placed in said second position, whereby sheets of paper of another kind different from said one kind are fed to said printing assembly via said platen along said second paper inlet path when said bracket device is placed in its second position.

12. A paper feeding apparatus for a printer including a printing assembly, which comprises:

a first paper stacker for storing a stack of paper sheets;

a paper feeding device for feeding said paper sheets one after another from said first paper stacker to said printing assembly, said paper feeding device including at least one feed roller disposed so as to be in contact with a top sheet of said stacker stored in said first paper stacker;

a second paper stacker for receiving the printed paper sheets after they are printed by said printing assembly;

drive means operatively connected to said feed roller for rotating said feed roller;

trigger means for starting said drive means; and a control device, connected to said drive means and said trigger means, for controlling said drive means to operate said drive means at one speed for a predetermined initial time interval after activation of said trigger means, and at another speed higher than said one speed for a predetermined subsequent time interval, whereby said feed roller is rotated at a low speed corresponding to said one speed for said initial time interval, and at a higher speed corresponding to said another speed for said subsequent time interval.

13. A paper feeding apparatus as recited in claim 12, which further comprises paper ejection means including at least a pair of ejection rollers for ejecting the printed paper sheets into said second paper stacker.

14. A paper feeding apparatus as recited in claim 12, wherein said drive means comprises a stepper motor operated under control of said control device.

15. A paper feeding apparatus as recited in claim 12, which further comprises:

support means, retained by a frame secured to the printer, for supporting said second paper stacker pivotally between a first position at which said second paper stacker is operative to receive the printed sheets originally stored in said first paper stacker, and a second position at which said second paper stacker is inoperative and an open space is provided adjacent said second paper stacker and above said printing assembly, said open space providing a paper inlet path along which a sheet of paper different from said paper sheets is fed to said printing assembly when said second paper stacker is placed in said second position.

16. A paper feeding apparatus for a printer having a printing assembly, which comprises:

a frame secured to said printer;

a first paper handling assembly supported by said frame and having a first paper stacker for storing sheets of paper of one kind and a paper feeding device for feeding said sheets of paper of one kind from said first paper stacker along a first paper inlet path to said printing assembly, said paper feeding device including a drive shaft which extends in parallel to a line of printing by said printing assembly, said drive shaft supporting a feed drive roller which is normally kept in rolling contact with the top sheet of the paper of said one kind stored on said first paper stacker for feeding said top sheet along said first paper inlet path;

a second paper handling assembly having a second paper stacker for receiving said sheets of paper of said one kind after they are printed by said printing assembly; and support means including a bracket device supported by said drive shaft pivotally about an axis of the drive shaft, said support means supporting said second paper handling assembly pivotally between a first position at which the second paper handling assembly is operative to receive the printed sheets of paper of said one kind in said second paper stacker, and a second position at which the second paper handling assembly is inoperative and a second paper inlet path leading to said printing assembly is provided adjacent said second paper handling assembly, whereby sheets of paper of another kind different from said one kind are loaded to said printing assembly along said second paper inlet path when said second paper handling assembly is placed in its second position.

17. A paper feeding apparatus for a printer including a printing assembly, which comprises:

a first paper stacker for storing a stack of paper sheets;

a paper feeding device for feeding said paper sheets one after another to said printing assembly, said paper feeding device including at least one feed roller disposed adjacent said first paper stacker;

a second paper stacker for receiving the printed paper sheets after they are printed by said printing assembly;

drive means including a stepper motor operable to rotate said feed roller;

trigger means for starting said stepper motor; and a control device connected to said stepper motor and said trigger means and including a motor drive circuit for driving said stepper motor, said control device controlling said stepper motor to operate the stepper motor at one speed for a predetermined initial time interval after activation of said trigger means, and at another speed higher than said one speed for a predetermined subsequent time interval, said control device further including a first oscillator generating pulse signals at one frequency and a second oscillator generating pulse signals at another frequency higher than said one frequency, said pulse signals generated by said first and second oscillators being selectively applied to said motor drive circuit.

18. A paper feeding apparatus as recited in claim 17, wherein said control device further includes a first timer determining said initial time interval during which said pulse signals of said first oscillator are applied to said motor drive circuit, and a second timer determining said subsequent time interval during which said pulse signals of said second oscillator are applied to said motor drive circuit.

19. A paper feeding apparatus for a printer including a printing assembly, which comprises:

a first paper stacker including a receiver plate for storing a stack of paper sheets;

a paper feeding device for feeding said paper sheets one after another to said printing assembly, said paper feeding device including at least one feed roller disposed adjacent said first paper stacker;

a stacker drive motor to move said receiver plate of the first paper stacker away from said feed roller;

a second paper stacker for receiving the printed paper sheets after they are printed by said printing assembly;

support means, retained by a frame secured to the printer, for supporting said second paper stacker pivotally between a first position at which said second paper stacker is operative to receive the printed sheets originally stored in said first paper stacker, and a second position at which said second paper stacker is inoperative and an open space is provided adjacent said second paper stacker and above said printing assembly, said open space providing a paper inlet path along which a sheet of paper different from said paper sheets is fed to said printing assembly when said second paper stacker is placed in said second position;

drive means operatively connected to said feed roller for rotating said feed roller;

trigger means for starting said drive means;

a control device, connected to said drive means and said trigger means, for controlling said drive means to operate said drive means at one speed for a predetermined initial time interval after activation of said trigger means, and at another speed higher than said one speed for a predetermined subsequent time interval; and detection means for detecting the selected position of said second paper stacker, and supplying, when said second paper stacker is pivoted to said second position, a signal to said control device to operate said stacker drive motor such that said receiver plate of said first paper stacker is located at an inoperative position at which the top of said stack of paper sheets is positioned away from said feed roller.

* * * * *